US007055680B2

(12) United States Patent
Liebers

(10) Patent No.: US 7,055,680 B2
(45) Date of Patent: Jun. 6, 2006

(54) HANGER FOR CASE HOLDING NONPRESCRIPTION READING GLASSES

(75) Inventor: Steven B. Liebers, Norristown, PA (US)

(73) Assignee: Diversified Products, Inc., Collegeville, PA (US)

( * ) Notice: Subject to any disclaimer, the term of this patent is extended or adjusted under 35 U.S.C. 154(b) by 47 days.

(21) Appl. No.: 10/871,725

(22) Filed: Jun. 18, 2004

(65) Prior Publication Data

US 2005/0279648 A1 Dec. 22, 2005

(51) Int. Cl.
*A45C 11/04* (2006.01)

(52) U.S. Cl. ..... 206/5; 206/460; 206/471; 206/806; D9/722

(58) Field of Classification Search ..... 206/5, 206/6, 460, 461, 471, 495, 806; D9/415, D9/722

See application file for complete search history.

(56) References Cited

U.S. PATENT DOCUMENTS 646,638 A * 4/1900 Cutler ..... 229/75
3,136,409 A * 6/1964 Schumann ..... 206/361
3,329,386 A * 7/1967 Rosen ..... 248/340
3,370,733 A * 2/1968 Giesler ..... 206/446
3,884,443 A 5/1975 McMaster
4,132,309 A * 1/1979 Shaylor ..... 206/278
4,257,522 A * 3/1981 Thorneburg ..... 206/299
D261,481 S * 10/1981 Haubert ..... D9/759
D264,185 S * 5/1982 Roberts ..... D9/433
5,002,187 A * 3/1991 Rysner et al. ..... 206/461
5,044,773 A * 9/1991 Harms et al. ..... 383/22
5,046,696 A 9/1991 Lee
5,484,056 A 1/1996 Wood
5,672,238 A 9/1997 Samuelson
5,791,608 A * 8/1998 Nielsen et al. ..... 248/110
5,823,503 A 10/1998 Wasserman
RE36,258 E 7/1999 Coward et al.
6,032,793 A * 3/2000 Oakley ..... 206/296
6,575,295 B1 * 6/2003 Mayfield ..... 206/15.3

OTHER PUBLICATIONS

Five (5) photographs (identified as Sheets 1 through 5) of the "Slim-Line Ultra-Thin Readers" packaging, undated.

* cited by examiner

*Primary Examiner*—David T. Fidei
(74) *Attorney, Agent, or Firm*—Caesar, Rivise, Bernstein, Cohen & Pokotilow, Ltd.

(57) ABSTRACT

A hanger for a case holding a pair of glasses is provided which includes a web of flexible material having an elongate main body portion having an upper end and a lower end, a pair of tabs extending from the lower end of the main body portion adapted to encircle the case, and an aperture adjacent to the upper end of the main body portion adapted to receive a support for hanging the hanger holding the case.

13 Claims, 2 Drawing Sheets

HANGER FOR CASE HOLDING NONPRESCRIPTION READING GLASSES

BACKGROUND OF THE INVENTION

This invention relates to a display hanger for an eyeglasses case for use on a hanging type display stand.

Various display hangers exist in the prior art for hanging various articles, such as hand tools and the like. For example, U.S. Pat. No. 5,484,056 (Wood) teaches a display hanger for suspending an article such as a screwdriver. A special elastomeric grommet is used to hang the tool.

Additionally, U.S. Pat. No. 3,884,443 (McMaster) teaches a pressure-sensitive hanger for small articles such as merchandise packages, wall packages and the like that can be hung on display rods or hooks. This invention is directed to a universal hanger that is applied with adhesive to a small item. Here, a means to prevent peeling of the hanger from the product to which it is secured is included.

Various eyeglass holders are also known. For example, U.S. Pat. No. 5,046,696 (Lee) teaches a holder for eyeglasses which accepts a temple portion of an eyeglass frame for supporting eyeglasses in a vertical position. The holder may be mounted, for example, in an automobile, boat or convenient location in a home. The design includes a planar first member and a second member integral to the first which protrudes outwardly. An opening between the first and second members accepts the temple of the eyeglass frame. An adhesive is applied to a surface of the first member for adhesion of the device to another surface.

However, to this point, a very simple and inexpensive hanger for a glasses case has not been known that allows a user remove the glasses case from a display rack, allows a user to open the glasses case to remove a pair of glasses therein to try the glasses on for appearance and strength of lenses, and that maintains the integrity of the hanger so that the glasses can be reinserted into the case and the case can be re-hung on a display rack.

All references cited herein are incorporated herein by reference in their entireties.

BRIEF SUMMARY OF THE INVENTION

A hanger for a case holding a pair of glasses is provided which includes a web of flexible material having an elongate main body portion having an upper end and a lower end, a pair of tabs extending from the lower end of the main body portion adapted to encircle the case, and an aperture adjacent to the upper end of the main body portion adapted to receive a support for hanging the hanger holding the case. The web of flexible material is preferably a web of thin plastic material such as polyvinylchloride. Alternatively, the web of flexible material may be constructed from, for example, a paper product. The tabs extending from the lower end of the main body portion may have adhesive thereon whereby the tabs are adapted to adhere to the case. The adhesive may be, for example, double-backed tape. The main body portion and the pair of tabs preferably form a generally upside down T-shape.

The present invention is also directed to the combination of a hanger and a case holding a pair of glasses. Again, the hanger is a web of flexible material having an elongate main body portion having an upper end and a lower end, a pair of tabs extending from the lower end of the main body portion adapted to encircle the case, and an aperture adjacent to the upper end of the main body portion adapted to receive a support for hanging the hanger holding the case. The case holds the pair of glasses in a folded configuration in a central compartment. The reading glasses may be non-prescription reading glasses.

The case preferably has an upper lid section and a lower body portion and the tabs are adhered to the lower body portion only such that the upper lid section may be removed without disturbing the tabs adhered to the lower body portion.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figure 1:
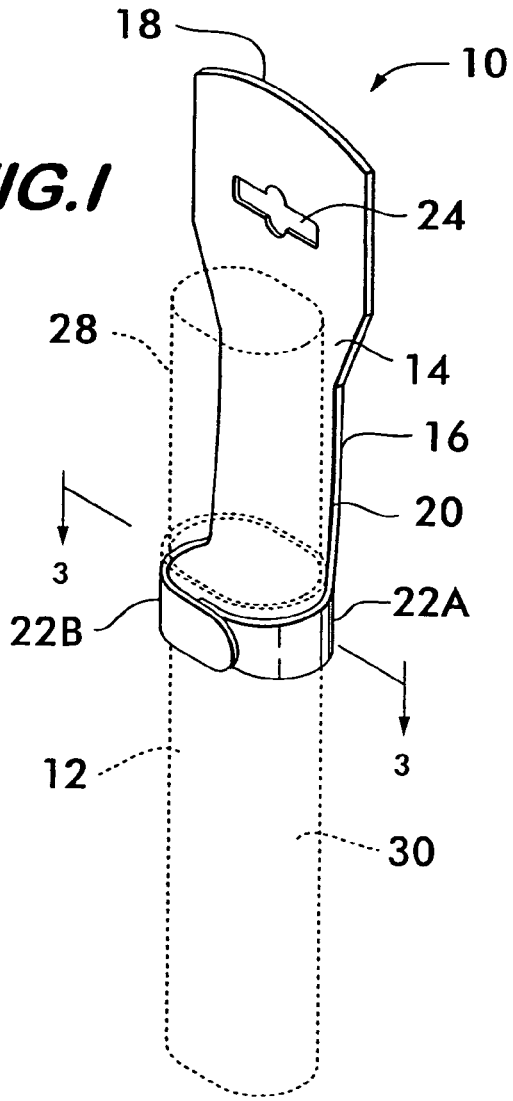
FIG. 1 is an isometric view of a hanger for a case holding non-prescription reading glasses in accordance with a preferred embodiment of the present invention, where the dotted lines represent the case.
Figure 2:
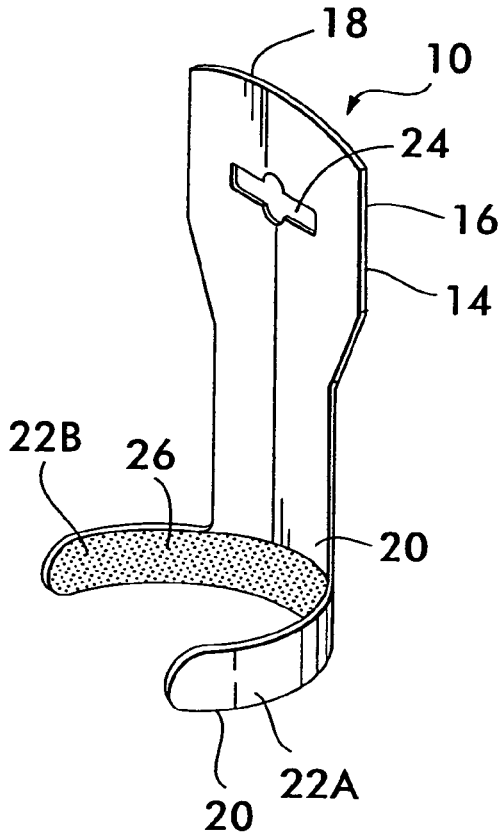
FIG. 2 is an isometric view of the hanger for a case holding non-prescription reading glasses of FIG. 1, shown prior to installation on the case.
Figure 3:
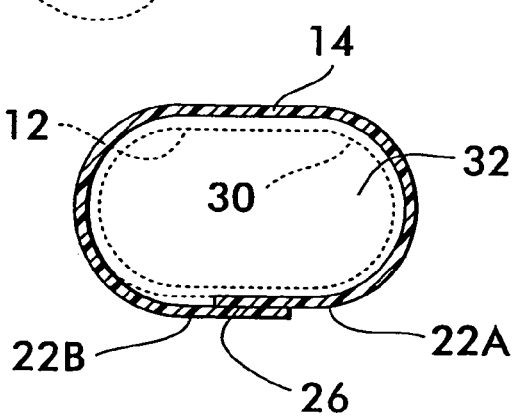
FIG. 3 is a cross-sectional view of the hanger for a case holding non-prescription sun glasses of FIG. 1, taken substantially along lines 3—3 of FIG. 1.

Referring now to the drawings wherein like part numbers refer to like elements throughout the several views, there is shown FIGS. 1–3 a hanger 10 for a case 12 holding a pair of glasses in accordance with one preferred embodiment of the present invention. The hanger 10 is constructed from a web 14 of flexible material. The hanger has an elongated main body portion 16 having an upper end 18 and a lower end 20, a pair of tabs 22A, 22B extending from the lower end 20 of the main body portion 16 that encircle the case 12, and an aperture 24 adjacent to the upper end 18 of the main body portion 16 that is formed to receive a support for hanging the hanger 10 holding the case 12.

Preferably, the web 14 of flexible material is thin plastic material such as polyvinylchloride (PVC). However, the web 14 may be made from a paper product such as thin cardboard or the like so long as the web 14 has sufficient strength to support the case 12 on a rack by use of hook through the aperture 24.

Preferably, the tabs 22A, 22B that extend from the lower end 20 of the main body portion 16 have adhesive 26 thereon. The tabs 22A, 22B encircle the case 12 and may be adhered to one another, to the case 12 alone or to both one another and the case 12. The adhesive may be a double-backed tape and is preferably has a release liner strip (not shown) to assist in assembly.

The case may be, for example, oval in cross-sectional shape, rectangular, or any other cross-sectional shape that is suitable to hold a pair of glasses or reading glasses.

The hanger 10 is preferably very inexpensively manufactured as essentially a two-dimensional object and is preferably in the form of an upside down T-shape where the tabs 22A, 22B are at the lower end 20 of the main body portion 16.

Figure 4:
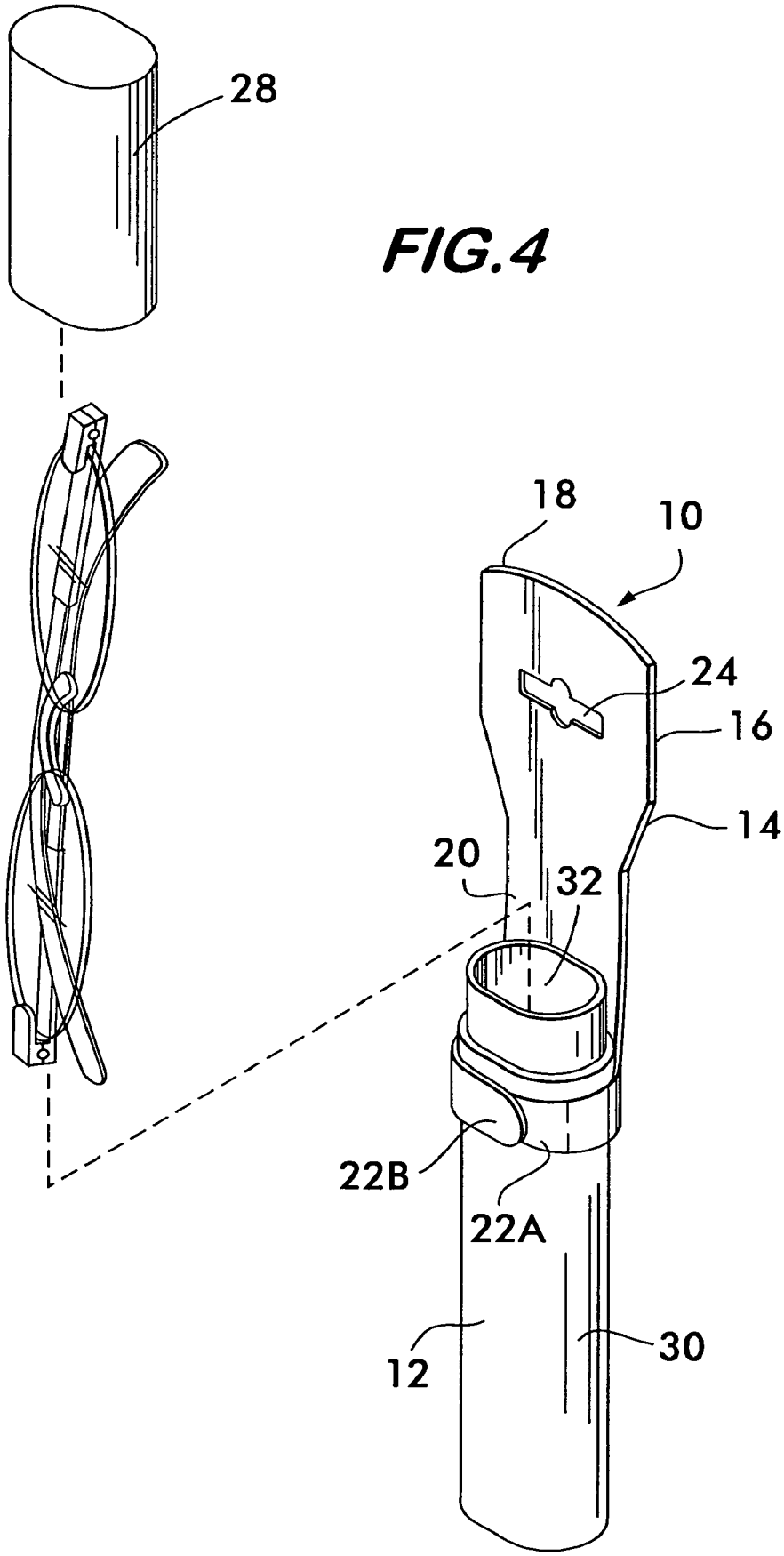
FIG. 4 is an isometric view of the hanger for a case holding non-prescription reading glasses of FIG. 1 along with a case, shown with the lid of the case and glasses in a removed condition.

As shown in FIG. 4, the case 12 is preferably of a two-piece design. That is, the case 12 preferably has an upper lid portion 28 that slides onto a lower main body portion 30. The tabs 22A, 22B of the hanger attach to either the upper lid portion 28 or the lower main body portion 30 such that the lid portion 28 can be removed and a pair of glasses (in a folded configuration) in a central compartment 32 the main body portion 30 can be withdrawn. A user can then try on the glasses and determine if the strength of the glasses is appropriate (for example, where the glasses are reading glasses) and determine if the style is appropriate.

While the invention has been described in detail and with reference to specific examples thereof, it will be apparent to one skilled in the art that various changes and modifications can be made therein without departing from the spirit and scope thereof.

What is claimed is:

1. A hanger and a glasses case holding a pair of glasses, comprising a web of flexible material, said web having an elongate main body portion having an upper end and a lower end and a vertical axis, a pair of tabs extending from the lower end of the main body portion encircling the case, the tabs being thin strips having a pair of parallel edges, both parallel edges being perpendicular to the vertical axis and having straight edges, and an aperture adjacent to the upper end of the main body portion adapted to receive a support for hanging the hanger holding the case.

2. The hanger of claim 1, wherein the web of flexible material is a web of thin plastic material.

3. The hanger of claim 1, wherein the web of flexible material is a web of polyvinylebloride.

4. The hanger of claim 1, wherein the web of flexible material is constructed from a paper product.

5. The hanger of claim 1, wherein the tabs extending from the lower end of the main body portion have adhesive thereon whereby the tabs are adapted to adhere to the case.

6. The hanger of claim 5, wherein the adhesive is double-backed tape.

7. The hanger of claim 1, wherein the main body portion and the pair of tabs form a generally upside down T-shape.

8. A hanger and a case holding a pair of glasses, said hanger comprising a web of flexible material having an elongate main body portion having an upper end and a lower end and a vertical axis, a pair of tabs extending from the lower end of the main body portion adapted to encircle the case, the tabs being thin strips having a pair of parallel edges, both parallel edges being perpendicular to the vertical axis and having straight edges, and an aperture adjacent to the upper end of the main body portion adapted to receive a support for hanging the hanger holding the case, the case holding the pair of glasses in a folded configuration in a central compartment.

9. A hanger and a case holding a pair of glasses, said hanger comprising a web of flexible material having an elongate main body portion having an upper end and a lower end and a vertical axis, a pair of tabs extending from the lower end of the main body portion adapted to encircle the case, the tabs being thin strips having a pair of parallel edges, both parallel edges being perpendicular to the vertical axis and having straight edges, the tabs having adhesive thereon, whereby the tabs are adhered to the case, and an aperture adjacent to the upper end of the main body portion adapted to receive a support for hanging the hanger holding the case, the case holding the pair of glasses in a folded configuration in a central compartment.

10. The hanger and case of claim 9, wherein the adhesive is double-backed tape.

11. The hanger and case of claim 8, wherein the main body portion and the pair of tabs form a generally upside down T-shape.

12. The hanger and case of claim 8, wherein the reading glasses are non-prescription reading glasses.

13. The hanger and case of claim 8, wherein the case has an upper lid section and a lower body portion and the tabs are adhered to the lower body portion only such that the upper lid section may be removed without disturbing the tabs adhered to the lower body portion.

* * * * *